US006631620B2

(12) United States Patent
Gray et al.

(10) Patent No.: US 6,631,620 B2
(45) Date of Patent: Oct. 14, 2003

(54) ADAPTIVE REFRIGERATOR DEFROST METHOD AND APPARATUS

(75) Inventors: Steven Gray, Erie, PA (US); Timothy Dale Worthington, Crestwood, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/683,664

(22) Filed: Jan. 31, 2002

(65) Prior Publication Data

US 2003/0140639 A1 Jul. 31, 2003

(51) Int. Cl.[7] ..... F25B 47/02
(52) U.S. Cl. ..... 62/156; 62/155
(58) Field of Search ..... 62/156, 151, 154, 62/155, 275, 276, 80, 140, 128, 234

(56) References Cited

U.S. PATENT DOCUMENTS

| | | | | |
|---|---|---|---|---|
| 4,156,350 A | | 5/1979 | Elliott et al. | |
| 4,327,557 A | | 5/1982 | Clarke et al. | |
| 4,528,821 A | | 7/1985 | Tershak et al. | |
| 4,689,965 A | | 9/1987 | Janke et al. | |
| 4,745,629 A | | 5/1988 | Essig et al. | |
| 4,910,966 A | * | 3/1990 | Levine et al. | 62/156 X |
| 4,932,217 A | * | 6/1990 | Meyer | 62/155 X |
| 4,938,027 A | | 7/1990 | Midlang | |
| 5,038,575 A | * | 8/1991 | Yamada | 62/156 X |
| 5,295,361 A | * | 3/1994 | Novak et al. | 62/155 X |
| 5,463,875 A | | 11/1995 | Shavit | |
| 5,564,286 A | | 10/1996 | Suse | |
| 5,692,385 A | | 12/1997 | Hollenbeck et al. | |
| 5,765,382 A | | 6/1998 | Manning et al. | |

* cited by examiner

*Primary Examiner*—Harry B. Tanner
(74) *Attorney, Agent, or Firm*—H. Neil Houser, Esq.; Armstrong Teasdale LLP

(57) ABSTRACT

A method and apparatus for defrosting an evaporator of a refrigeration system including a defrost heater and a controller operatively connected to the evaporator and a defrost heater is provided. The method comprises initiating a defrost cycle to energize the defrost heater to defrost the evaporator, monitoring a temperature of the evaporator, terminating the defrost cycle by de-energizing the defrost heater when a low temperature termination point of the evaporator is reached when in a low temperature defrost cycle, and terminating the defrost cycle by de-energizing the defrost heater when a high temperature termination point of the evaporator is reached when in a high temperature defrost cycle.

24 Claims, 8 Drawing Sheets

Defrost Control State Diagram

ADAPTIVE REFRIGERATOR DEFROST METHOD AND APPARATUS

BACKGROUND OF INVENTION

This invention relates generally to refrigerators and, more particularly, to a method and apparatus for controlling refrigeration defrost cycles.

Known frost free refrigerators include a refrigeration defrost system to limit frost buildup on evaporator coils. Conventionally, an electromechanical timer is used to energize a defrost heater after a pre-determined run time of the refrigerator compressor to melt frost buildup on the evaporator coils. To prevent overheating of the freezer compartment during defrost operations when the heater is energized, in at least one type of defrost system the compartment is pre-chilled. After defrost, the compressor is typically run for a predetermined time to lower the evaporator temperature and prevent food spoilage in the refrigerator and/or fresh food compartments of a refrigeration appliance.

Such timer-based defrost systems, however are not as energy efficient as desired. For instance, they tend to operate regardless of whether ice or frost is initially present, and they often pre-chill the freezer compartment regardless of initial compartment temperature. In addition, the defrost heater is typically energized without temperature regulation in the freezer compartment, and the compressor typically runs after a defrost cycle regardless of the compartment temperature. Such open loop defrost control systems, and the accompanying inefficiencies are undesirable in light of increasing energy efficiency requirements.

Recognizing the limitations of such timer-based defrost systems, efforts have been made to provide adaptive defrost systems employing limited feedback, such as door openings and compressor and evaporator conditions, for improved energy efficiency of defrost cycles. As such, unnecessary defrost cycles are avoided and the defrost heater is cycled on and only as necessary, such as until the evaporator reaches a fixed termination temperature. See, for example, U.S. Pat. No. 4,528,821. However, achieving some defrost goals, such as melting all of the frost off of the evaporator and melting ice out of an icemaker fill tube, are detrimental to achieving other defrost goals, such as maintaining freezer compartment temperatures at sufficient levels during defrost operations to prevent freezer burn and moisture formation/ice buildup in the freezer compartment. Known defrost systems have not resolved these difficulties.

SUMMARY OF INVENTION

In one aspect, a method for defrosting an evaporator of a refrigeration system, the method utilizing a defrost heater and a controller operatively connected to the evaporator and a defrost heater, is provided. The method comprises initiating a defrost cycle to energize the defrost heater to defrost the evaporator, monitoring a temperature of the evaporator, terminating the defrost cycle by de-energizing the defrost heater when a low temperature termination point of the evaporator is reached when in a low temperature defrost cycle, and terminating the defrost cycle by de-energizing the defrost heater when a high temperature termination point of the evaporator is reached when in a high temperature defrost cycle.

In another aspect, a method for defrosting a refrigeration unit including an evaporator, a defrost heater, and a controller operatively connected to the evaporator and the defrost heater is provided. The controller includes a defrost counter, and the method comprises initiating a defrost cycle to energize the defrost heater to defrost the evaporator, selecting a low temperature defrost cycle when the defrost counter is less than a predetermined value, and selecting a high temperature defrost cycle when the defrost counter equals said predetermined value.

In still another aspect, a method for defrosting a refrigerator including a sealed system, an evaporator, a defrost heater, and a controller operatively connected to the evaporator and a defrost heater is provided. The controller includes a defrost counter and a defrost timer. The method comprises initiating a defrost cycle to energize the defrost heater to defrost the evaporator, selecting a low temperature defrost cycle when the defrost counter is less than a predetermined value, selecting a high temperature defrost cycle when the defrost counter equals the predetermined value, terminating the low temperature defrost cycle by de-energizing the defrost heater when a first temperature termination point of the evaporator is reached when the low temperature defrost cycle is selected, terminating the high temperature defrost cycle by de-energizing the defrost heater when a second temperature termination point of the evaporator is reached when the high temperature defrost cycle is selected, the second termination temperature higher than the first termination temperature, comparing an elapsed defrost time to a reference defrost time when either of the high temperature defrost and low temperature defrost are terminated, selecting a normal or abnormal defrost interval based upon the compared elapsed defrost time and reference defrost time, and operating the sealed system for the selected defrost interval.

In still another aspect, a refrigeration defrost unit for an evaporator is provided. The defrost unit comprises a defrost heater, a controller operatively coupled to said defrost heater, and a thermistor adapted for sensing a temperature of the evaporator. The controller is configured to operate said defrost heater in a low temperature defrost mode de-energizing said defrost heater at a first temperature in response to said thermistor, and to operate said defrost heater in a high temperature defrost mode de-energizing said defrost heater at a second temperature in response to said thermistor, said second temperature higher than said first temperature.

In another aspect a refrigeration unit is provided that comprises a compressor, an evaporator, a defrost heater, and a controller. The controller is operatively coupled to said compressor, said evaporator and said defrost heater, and the controller comprises a defrost timer and operates said compressor in a normal mode and an abnormal load in response to a value of the defrost timer. The controller further comprises a defrost counter and operates said defrost heater in a high temperature defrost mode and a low temperature defrost mode based upon a value of said counter.

In a further aspect a refrigerator is provided which comprises a cabinet defining at least one refrigeration compartment, a sealed system for cooling said at least one refrigeration compartment, a defrost heater, and a controller operatively coupled to said sealed system and to the defrost heater. The controller is configured to adaptively control said defrost heater and said sealed system in a high temperature defrost mode and a low temperature defrost mode between normal and abnormal defrost intervals.

DETAILED DESCRIPTION

Figure 1:
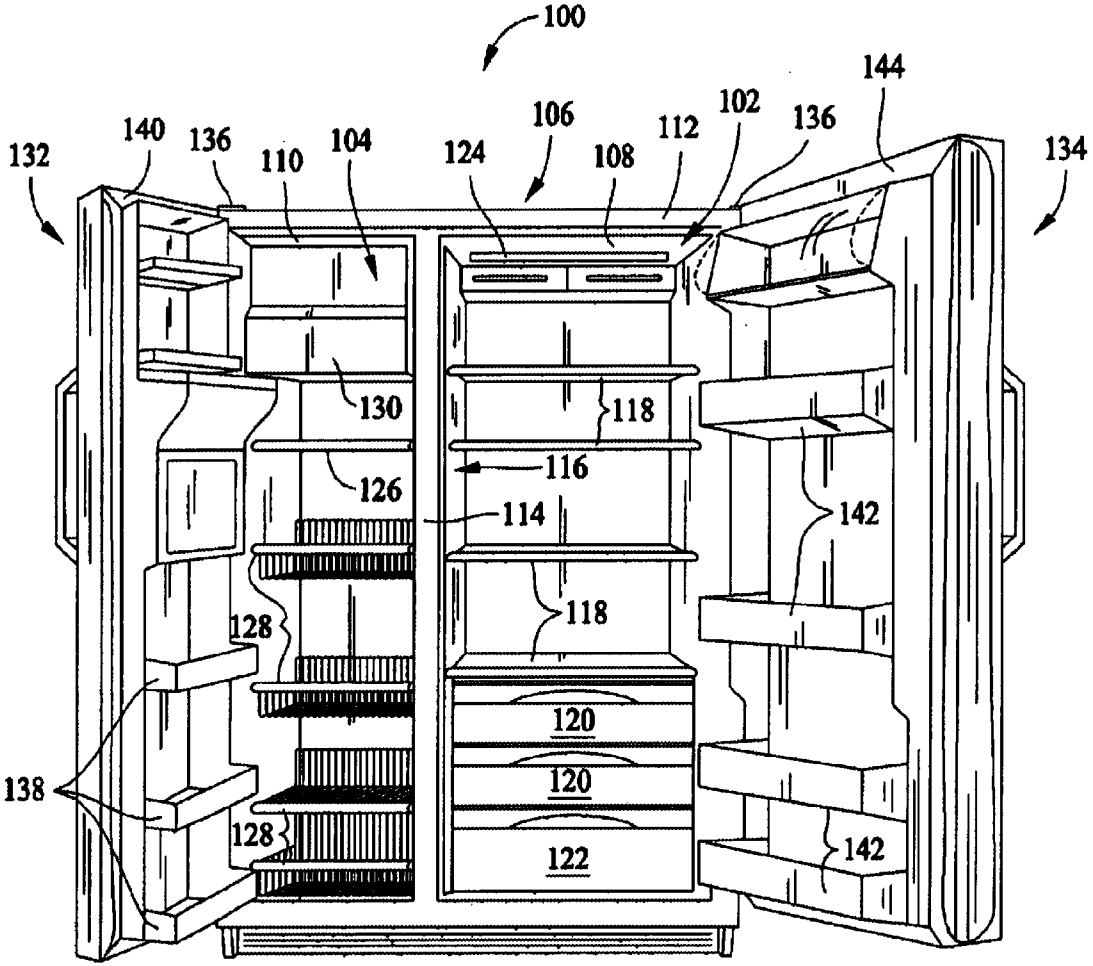
FIG. 1 is a perspective view of a refrigerator.

FIG. 1 illustrates a side-by-side refrigerator 100 in which the present invention may be practiced. It is recognized, however, that the benefits of the present invention apply to other types of refrigerators, freezers, and refrigeration appliances wherein frost free operation is desirable. Consequently, the description set forth herein is for illustrative purposes only and is not intended to limit the invention in any aspect.

Refrigerator 100 includes a fresh food storage compartment 102 and a freezer storage compartment 104 contained within an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 partly forms a quick chill and thaw system (not shown) and selectively controlled, together with other refrigerator features, by a microprocessor (not shown in FIG. 1) according to user preference via manipulation of a control interface 124 mounted in an upper region of fresh food storage compartment 102 and coupled to the microprocessor. A shelf 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

In accordance with known refrigerators, refrigerator 100 also includes a machinery compartment (not shown) that at least partially contains components for executing a known vapor compression cycle for cooling air. The components include a compressor (not shown in FIG. 1), a condenser (not shown in FIG. 1), an expansion device (not shown in FIG. 1), and an evaporator (not shown in FIG. 1) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown in FIG. 1). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator subject to the following control scheme.

Figure 2:
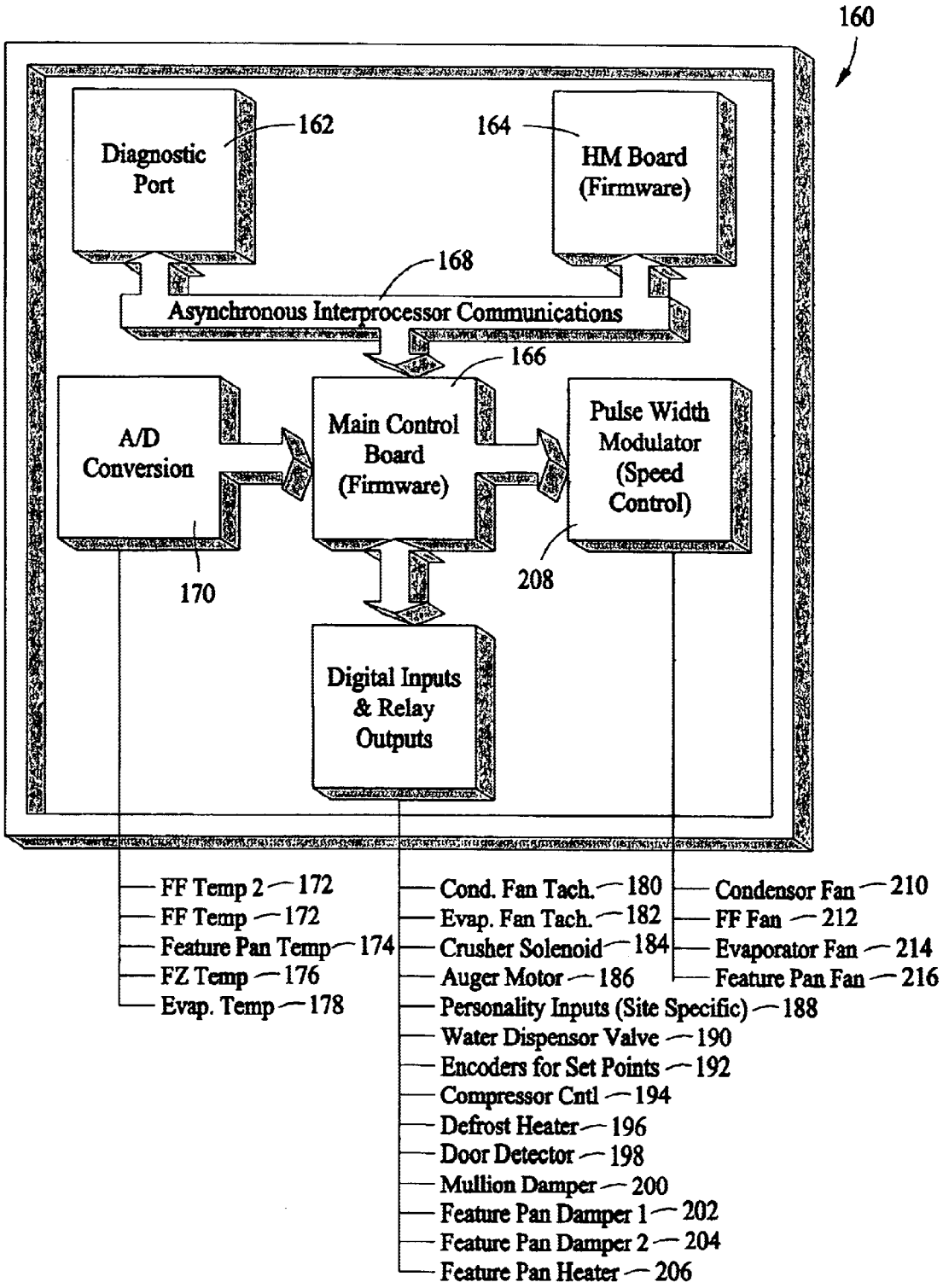
FIG. 2 is a block diagram of a refrigerator controller in accordance with one embodiment of the present invention.

FIG. 2 illustrates a controller 160 in accordance with one embodiment of the present invention. Controller 160 can be used, for example, in refrigerators, freezers and combinations thereof, such as, for example side-by-side refrigerator 100 (shown in FIG. 1).

Controller 160 includes a diagnostic port 162 and a human machine interface (HMI) board 164 coupled to a main control board 166 by an asynchronous interprocessor communications bus 168. An analog to digital converter (A/D converter) 170 is coupled to main control board 166. A/D converter 170 converts analog signals from a plurality of sensors including one or more fresh food compartment temperature sensors 172, a quick chill/thaw feature pan (i.e., pan 122 shown in FIG. 1) temperature sensors 174 (shown in FIG. 8), freezer temperature sensors 176, external temperature sensors (not shown in FIG. 2), and evaporator temperature sensors 178 into digital signals for processing by main control board 166.

In an alternative embodiment (not shown), A/D converter 170 digitizes other input functions (not shown), such as a power supply current and voltage, brownout detection, compressor cycle adjustment, analog time and delay inputs (both use based and sensor based) where the analog input is coupled to an auxiliary device (e.g., clock or finger pressure activated switch), analog pressure sensing of the compressor sealed system for diagnostics and power/energy optimization. Further input functions include external communication via IR detectors or sound detectors, HMI display dimming based on ambient light, adjustment of the refrigerator to react to food loading and changing the air flow/pressure accordingly to ensure food load cooling or heating as desired, and altitude adjustment to ensure even food load cooling and enhance pull-down rate of various altitudes by changing fan speed and varying air flow.

Digital input and relay outputs correspond to, but are not limited to, a condenser fan speed 180, an evaporator fan speed 182, a crusher solenoid 184, an auger motor 186, personality inputs 188, a water dispenser valve 190, encoders 192 for set points, a compressor control 194, a defrost heater 196, a door detector 198, a mullion damper 200, feature pan air handler dampers 202, 204, and a quick chill/thaw feature pan heater 206. Main control board 166 also is coupled to a pulse width modulator 208 for controlling the operating speed of a condenser fan 210, a fresh food compartment fan 212, an evaporator fan 214 associated with an evaporator 215 (shown in phantom in FIG. 3), and a quick chill system feature pan fan 216.

Figure 3A:
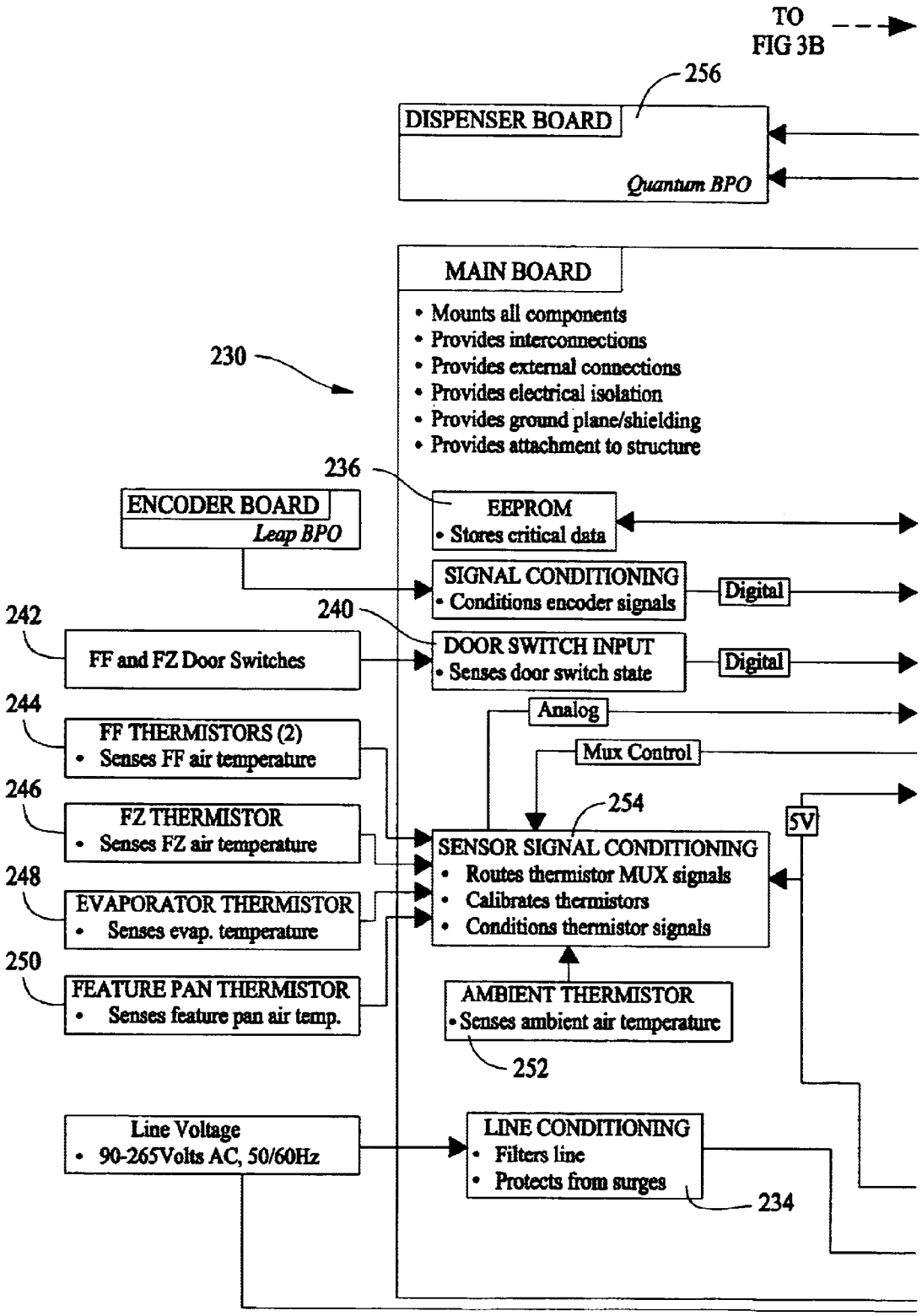
FIGS. 3A–3C show a block diagram of the main control board shown in FIG. 2.
Figure 3B:
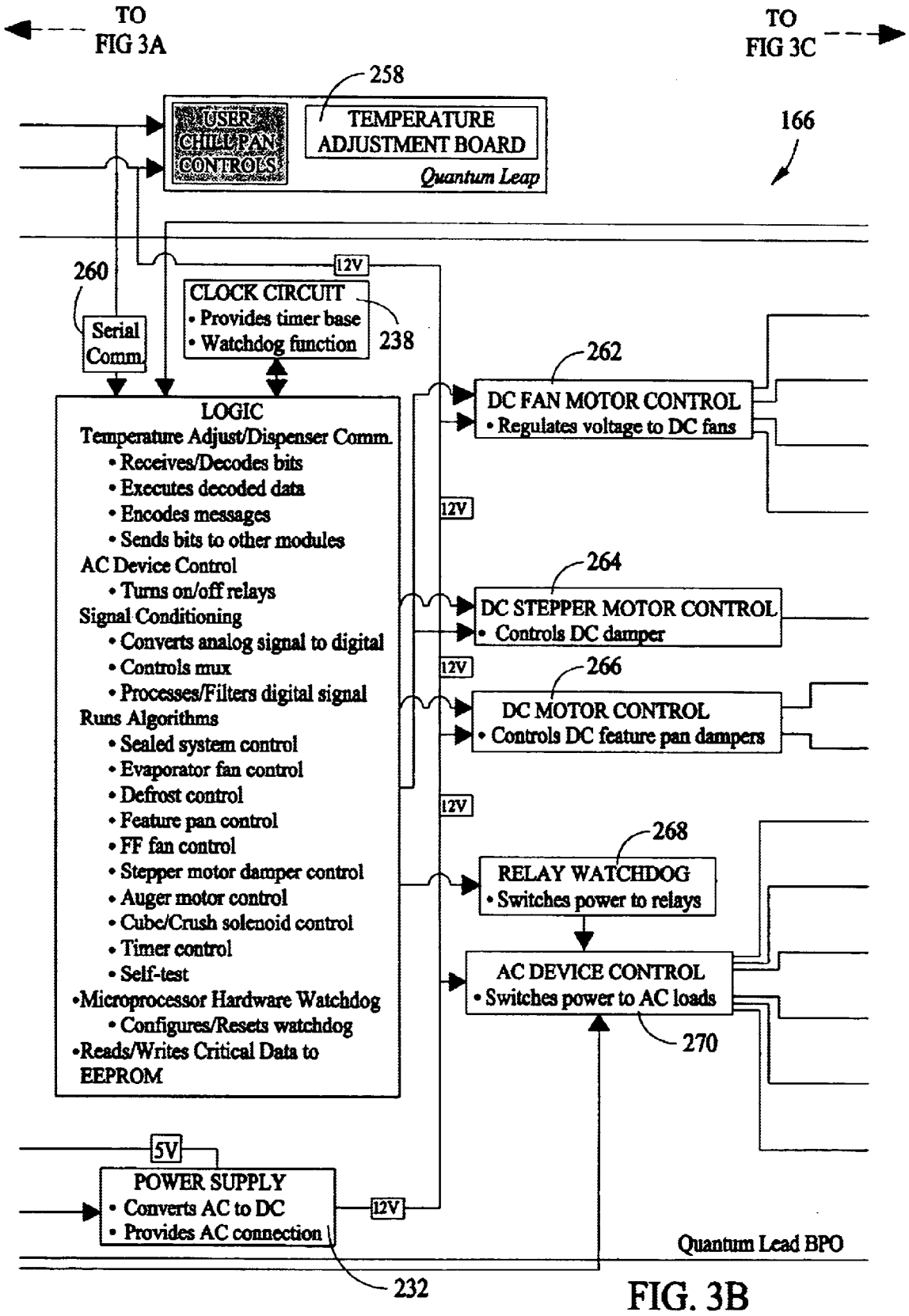
Figure 3C:
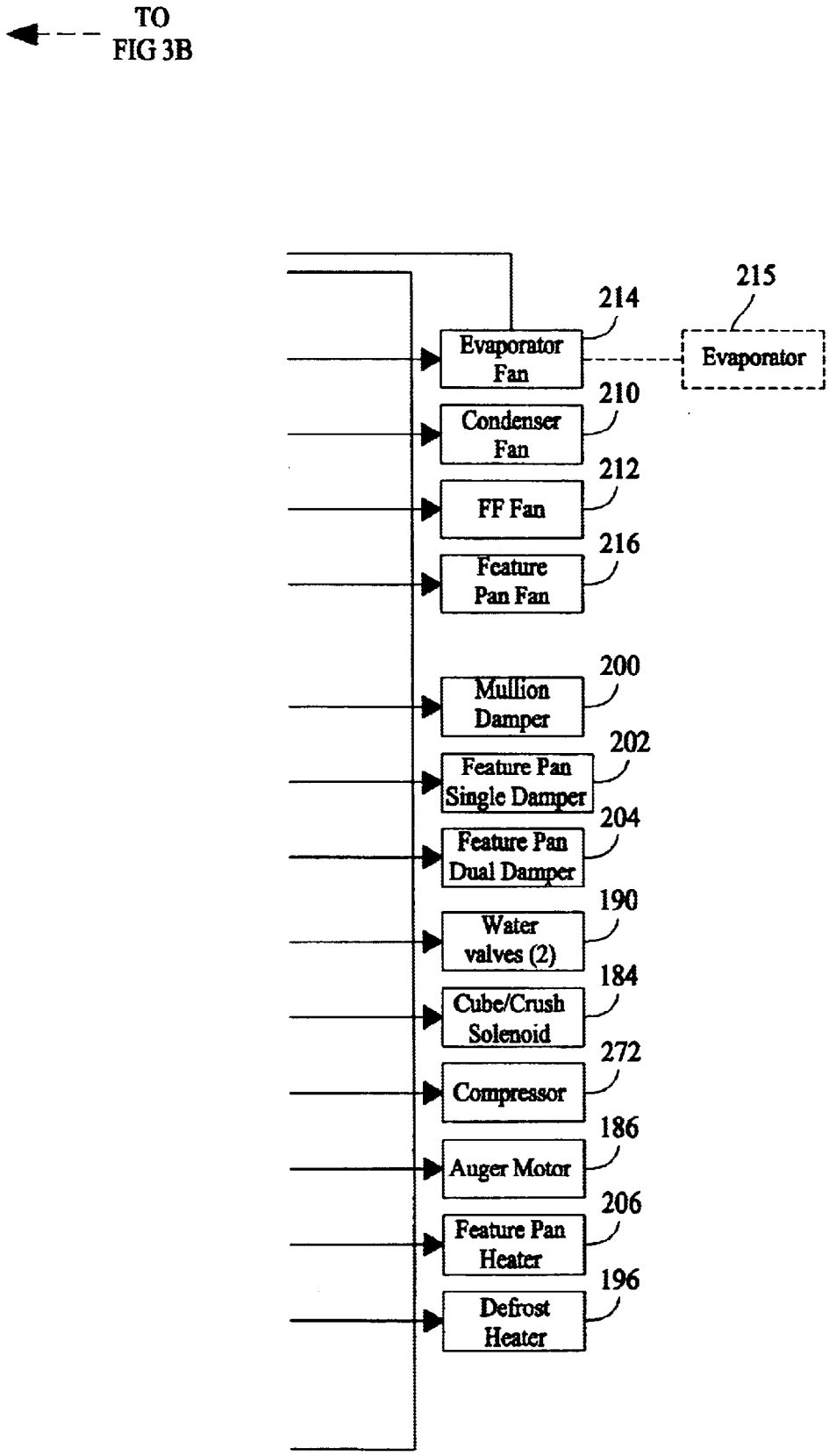
Figure 4:
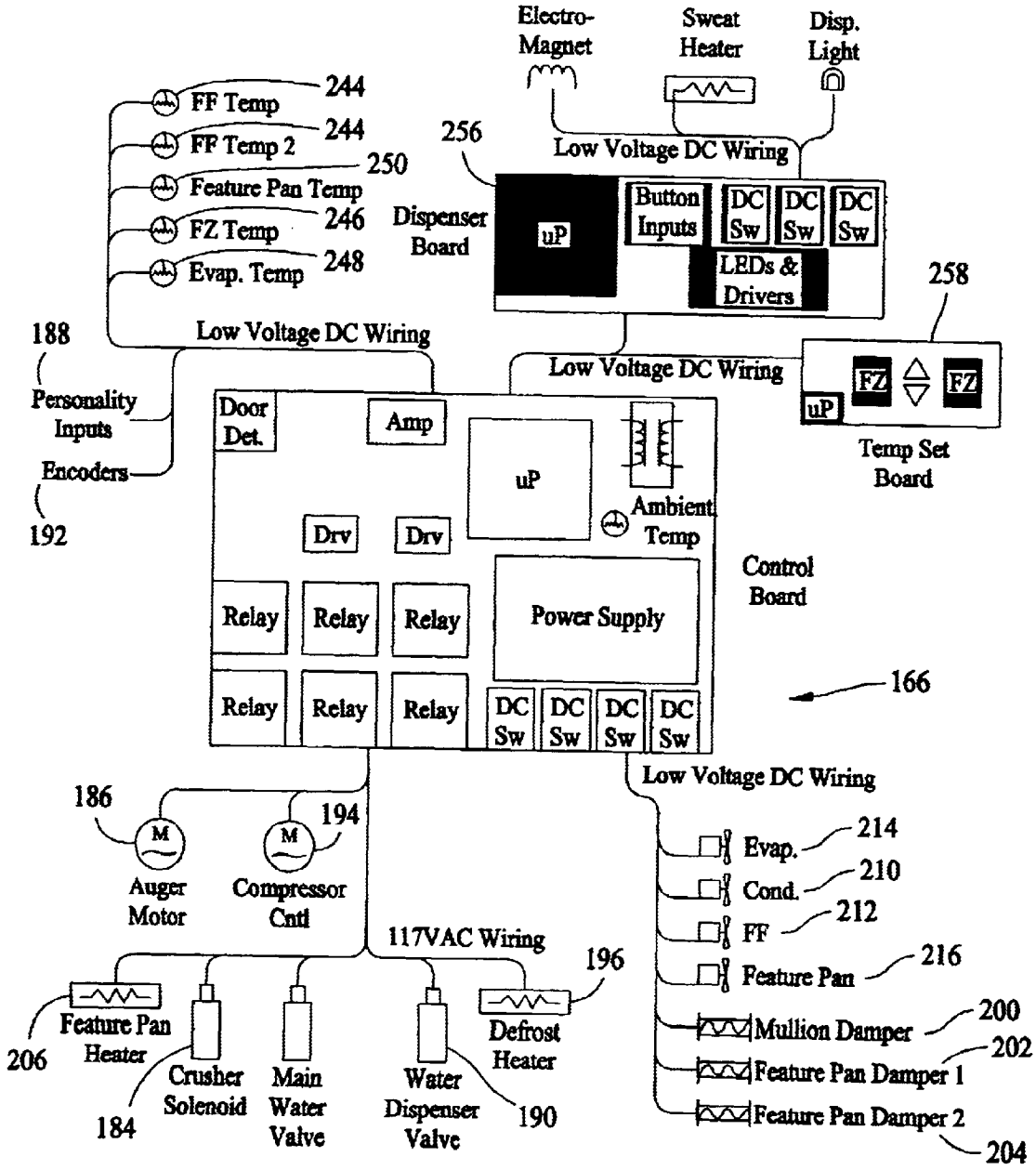
FIG. 4 is a block diagram of the main control board shown in FIG. 2.

FIGS. 3 and 4 are more detailed block diagrams of main control board 166. As shown in FIGS. 3 and 4, main control board 166 includes a processor 230. Processor 230 performs temperature adjustments/dispenser communication, AC device control, signal conditioning, microprocessor hardware watchdog, and EEPROM read/write functions. In addition, processor 230 executes many control algorithms including sealed system control, evaporator fan control, defrost control, feature pan control, fresh food fan control, stepper motor damper control, water valve control, auger motor control, cube/crush solenoid control, timer control, and self-test operations.

Processor 230 is coupled to a power supply 232 which receives an AC power signal from a line conditioning unit 234. Line conditioning unit 234 filters a line voltage which is, for example, a 90–265 Volt AC, 50/60 Hz signal. Processor 230 also is coupled to an EEPROM 236 and a clock circuit 238.

A door switch input sensor 240 is coupled to fresh food and freezer door switches 242, and senses a door switch state. A signal is supplied from door switch input sensor 240 to processor 230, in digital form, indicative of the door switch state. Fresh food thermistors 244, a freezer thermistor 246, at least one evaporator thermistor 248, a feature pan thermistor 250, and an ambient thermistor 252 are coupled to processor 230 via a sensor signal conditioner 254. Conditioner 254 receives a multiplex control signal from processor 230 and provides analog signals to processor 230 representative of the respective sensed temperatures. Processor 230 also is coupled to a dispenser board 256 and a temperature adjustment board 258 via a serial communications link 260. Conditioner 254 also calibrates the above-described thermistors 244, 246, 248, 250, and 252.

Processor 230 provides control outputs to a DC fan motor control 262, a DC stepper motor control 264, a DC motor control 266, and a relay watchdog 268. Watchdog 268 is coupled to an AC device controller 270 that provides power to AC loads, such as to water valve 190, cube/crush solenoid 184, a compressor 272, auger motor 186, a feature pan heater 206, and defrost heater 196. DC fan motor control 266 is coupled to evaporator fan 214, condenser fan 210, fresh food fan 212, and feature pan fan 216. DC stepper motor control 266 is coupled to mullion damper 200, and DC motor control 266 is coupled to one of more sealed system dampers.

Processor logic uses many inputs to make control decisions pertaining to the present invention, including but not limited to Freezer Door State via light switch detection using optoisolators, Fresh Food Door State via light switch detection using optoisolators, Freezer Compartment Temperature via a thermistor, Evaporator Temperature via a thermistor, Compressor On Time, Time to Complete a Defrost, and User Desired Set Points via electronic keyboard and display or encoders.

The electronic controls activate many loads to control refrigerator functions and operation, many of which are beyond the scope of the present invention. Those loads having some effect on the defrost functions of the refrigerator include Multi-speed or variable speed (via PWM) fresh food fan, Multi-speed (via PWM) evaporator fan, Multi-speed (via PWM) condenser fan, Compressor Relay, Defrost Relay, and Drip pan heater Relay that activate the sealed system and defrost system components.

These and other functions of the above-described electronic control system are performed under the control of firmware implemented as small independent state machines. As is described in detail below, the electronic controls facilitate an effective defrost scheme that, unlike known defrost systems, employs more than one defrost interval (normal and abnormal) and more than one defrost cycle (high and low temperature defrost) dependant upon actual operating conditions for improved defrost performance. Low temperature defrost cycles having a reduced effect on freezer compartment temperature are typically executed, while high temperature defrost cycles having a greater effect on freezer compartment temperature are selectively executed only at predetermined intervals. Instances of freezer burn and moisture buildup in the freezer compartment are thereby substantially avoided while still achieving an energy efficient, effective defrost system.

Figure 5:
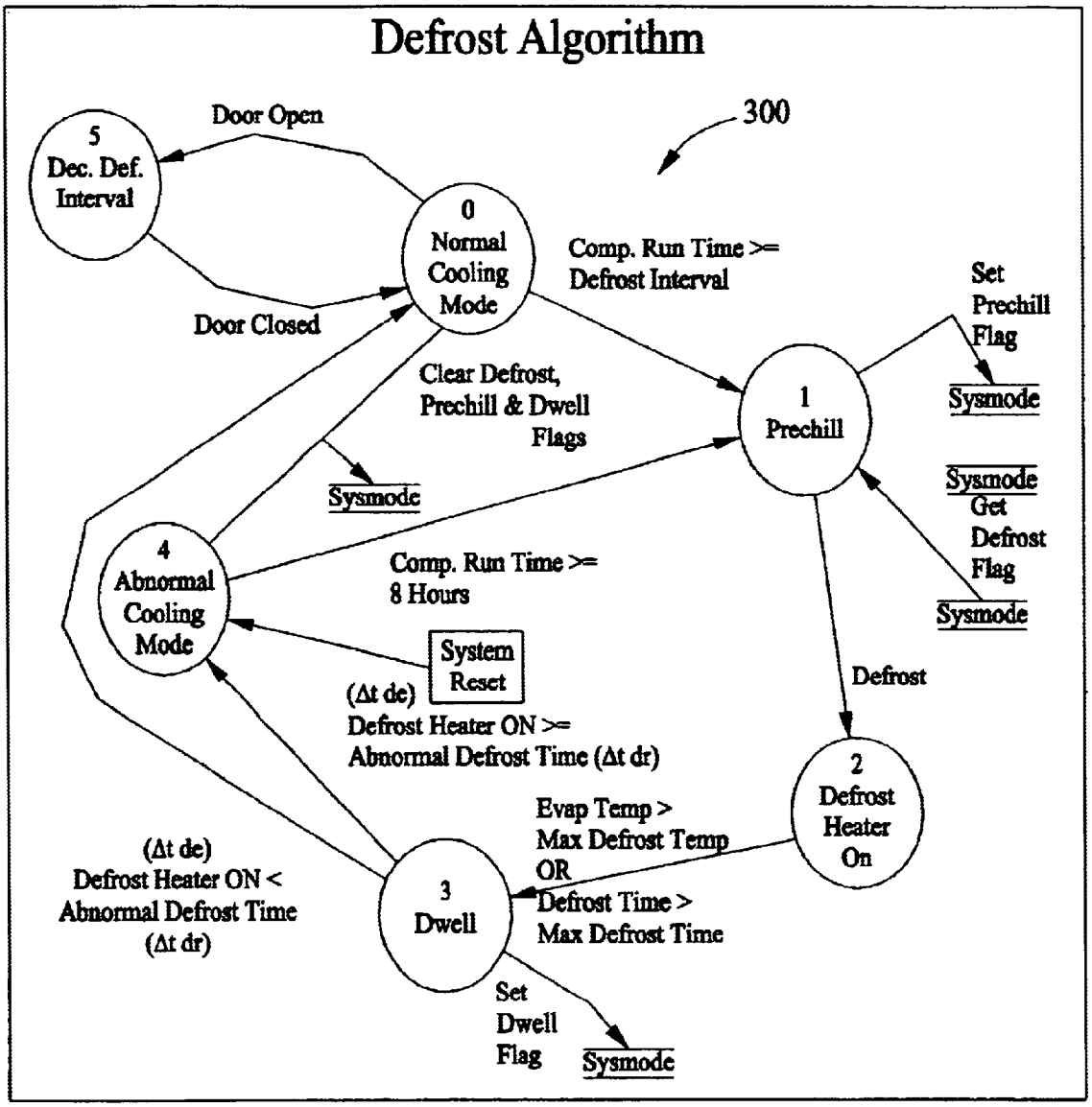
FIG. 5 is a defrost state diagram executable by a state machine of the controller shown in FIG. 2.

FIG. 5 is a defrost state diagram 300 illustrating a state algorithm executable by a state machine of controller 160 (shown in FIGS. 2–4). As will be seen, controller 160 adaptively determines an optimal defrost state based upon effectiveness of defrost cycles as they occur.

In an exemplary embodiment, by monitoring evaporator temperature over time, it is determined whether defrost cycles are deemed normal or abnormal. More specifically, when it is time to defrost, i.e. after an applicable defrost interval (explained below) has expired, the refrigerator sealed system is shut off, defrost heater 196 is turned on (at state 2), and a defrost timer is started. As the evaporator coils defrost, the temperature of the evaporator increases. When evaporator temperature reaches a predetermined termination temperature (dependant upon the high or low temperature defrost cycle explained below), the defrost heater 196 is shut off and the elapsed time defrost heater 196 was on ($\Delta t_{de}$) is recorded in system memory. Also, if the termination temperature is not reached within a predetermined maximum time, defrost heater 196 is shut off and the elapsed time the defrost heater was on is recorded in system memory.

The elapsed defrost time $\Delta t_{de}$ is then compared with a predetermined defrost reference time ($\Delta t_{dr}$) representative of, for example, an empirically determined or calculated elapsed defrost heater time to remove a selected amount of frost buildup on the evaporator coils that is typically encountered in the applicable refrigerator platform under predetermined usage conditions. If elapsed defrost time $\Delta t_{de}$ is greater than reference time $\Delta t_{dr}$, thereby indicating excessive frost buildup, a first or abnormal defrost interval, or time until the next defrost cycle, is employed If elapsed defrost time $\Delta t_{de}$ is less than reference time $\Delta t_{dr}$, a second or normal defrost interval, or time until the next defrost cycle is employed. The normal and abnormal defrost intervals, as defined below, are selectively employed, using $\Delta t_{dr}$ as a baseline, for more efficient defrost operation as refrigerator usage conditions change, thereby affecting frost buildup on the evaporator coils. In an exemplary embodiment, $\Delta t_{dr}$ is twenty minutes, although it is appreciated that $\Delta t_{dr}$ could be greater or lesser without departing from the scope of the present invention.

In one embodiment, the following control scheme automatically cycles between the first or abnormal defrost interval and the second or normal defrost interval on demand. When usage conditions are heavy and refrigerator doors 132, 134 (shown in FIG. 1) are opened frequently, thereby introducing more humidity into the refrigeration compartment, the system tends to execute the first or abnormal defrost interval repeatedly. When usage conditions are light and the doors opened infrequently, thereby introducing less humidity into the refrigeration compartments, the system tends to execute the second or normal defrost interval repeatedly. In intermediate usage conditions the system alternates between one or more defrost cycles at the first or abnormal defrost interval and one or more defrost cycles at the second or normal defrost interval.

Upon power up, controller 160 reads freezer thermistor 246 (shown in FIG. 3) over a predetermined period of time and averages temperature data from freezer thermistor 146 to reduce noise in the data. If the freezer temperature is determined to be substantially at or below a set temperature, thereby indicating a brief power loss, a defrost interval is read from EEPROM memory 236 (shown in FIG. 3) of controller 160, and defrost continues from the point of power failure without resetting defrost parameters. Periodically, controller 160 saves a current time till defrost value in system memory in the event of power loss. Controller 160 therefore recovers from brief power loses and associated defrost cycles due to resetting of the system from momentary power failures are therefore avoided.

If freezer temperature data indicates that freezer compartment 104 (shown in FIG. 1) is warm, i.e., at a temperature outside a normal operating range of freezer compartment, humid air is likely to be contained in freezer compartment 104, either because of a sustained power outage or opened doors during a power outage. Because of the humid air, a defrost timer is initially set to the first or abnormal defrost interval. In one embodiment the first or abnormal defrost interval is set to, for example, eight hours of compressor run time. For each second of compressor run time, the first defrost interval is decremented by a predetermined amount, such as one second, and the first defrost interval is generally unaffected by any other event, such as opening and closing of fresh food and freezer compartment doors 134, 132. In alternative embodiments, a first or abnormal defrost interval of greater or lesser than eight hours is employed, and decrement values of greater or lesser than one second are employed for optimal performance of a particular compressor system in a particular refrigerator platform.

When the first defrost interval has expired, controller 160 runs compressor 272 (see FIG. 3) for a designated pre-chill period or until a designated pre-chill temperature is reached (at state 1). Defrost heater 196 (shown in FIGS. 2–4) is energized (at state 2) to defrost the evaporator coils. Defrost heater 196 is turned on to defrost the evaporator coils either until a predetermined evaporator temperature has been reached or until a predetermined maximum defrost time has expired, and then a dwell state is entered (at state 3) wherein operation is suspended for a predetermined time period, which as described further below is dependent upon whether a high temperature or low temperature defrost cycle is executed.

Upon completion of an abnormal defrost cycle after the first or abnormal defrost interval has expired, controller 160 (at state 0) sets the time till defrost to the second or normal pre-selected defrost interval that is different from the first or abnormal time to defrost. Therefore, using the second defrost interval, a normal defrost cycle is executed. For example, in one embodiment, the second defrost interval is set to about 60 hours of compressor run time. In alternative embodiments, a second defrost interval of greater or lesser than 60 hours is employed to accommodate different refrigerator platforms, e.g., top-mount versus side-by-side refrigerators or refrigerators of varying cabinet size.

In one embodiment, the second defrost interval, unlike the first defrost interval, is decremented (at state 5) upon the occurrence of any one of several decrement events. For example, the second defrost interval is decremented (at state 5) by, for example, one second for each second of compressor run time. In addition, the second defrost interval is decremented by a predetermined amount, e.g., 143 seconds, for every second freezer door 132 (shown in FIG. 1) is open as determined by a freezer door switch or sensor 242 (shown in FIG. 3). Finally, the second defrost interval is decremented by a predetermined amount, such as 143 seconds in an exemplary embodiment, for every second fresh food door 134 (shown in FIG. 1) is open. In an alternative embodiment, greater or lesser decrement amounts are employed in place of the above-described one second decrement for each second of compressor run time and 143 second decrement per second of door opening. In a further alternative embodiment, the decrement values per unit time of opening of doors 132, 134 are unequal for respective door open events. In further alternative embodiments, greater or fewer than three decrement events are employed to accommodate refrigerators and refrigerator appliances having greater or fewer numbers of doors and to accommodate various compressor systems and speeds.

When the second or normal defrost interval has expired, controller 160 runs compressor 272 for a designated pre-chill period or until a designated pre-chill temperature is reached (at state 1). Defrost heater 196 is energized (at state 2) to defrost the evaporator coils. Defrost heater 196 is turned on to defrost the evaporator coils either until a predetermined evaporator temperature has been reached or until a predetermined maximum defrost time has expired. Defrost heater 196 is then shut off and the elapsed time defrost heater 196 was on ($\Delta t_{de}$) is recorded in system memory. A dwell state is then entered (at state 3) wherein sealed system operation is suspended for a predetermined time period. As will be seen further below, the duration of the dwell state is dependent upon the particular defrost cycle executed.

The elapsed defrost time $\Delta t_{de}$ is then compared with a predetermined defrost reference time $\Delta t_{dr}$. If elapsed defrost time $\Delta t_{de}$ is greater than reference time $\Delta t_{dr}$, thereby indicating excessive frost buildup, the first or abnormal defrost interval is employed for the next defrost cycle If elapsed defrost time $\Delta t_{de}$ is less than reference time $\Delta t_{dr}$, the second or normal defrost interval is employed for the next defrost cycle. The applicable defrost interval is applied and a defrost cycle is executed when the defrost interval expires. The elapsed defrost time $\Delta t_{de}$ of the cycle is recorded and compared to reference time $\Delta t_{dr}$ to determine the applicable defrost interval for the next cycle, and the process continues. Normal and abnormal defrost intervals are therefore selectively employed on demand in response to changing refrigerator conditions.

It is recognized that that other known reference data may be employed in lieu of elapsed defrost time as indicative of evaporator frost buildup to distinguish between normal and abnormal defrost cycles. For example, compressor and evaporator loads may be monitored to determine effectiveness of the sealed system due frost buildup on the evaporator coils, and pressure and temperature sensors may be employed on the evaporator and/or compressor to sense performance parameters and changes over time that are indicative of defrost effectiveness. In addition, other reference values, such as elapsed time to cool a refrigeration compartment to a given temperature, or total elapsed door-open time may be employed to evaluate and demarcate a need for a normal or abnormal defrost cycle.

Figure 6:
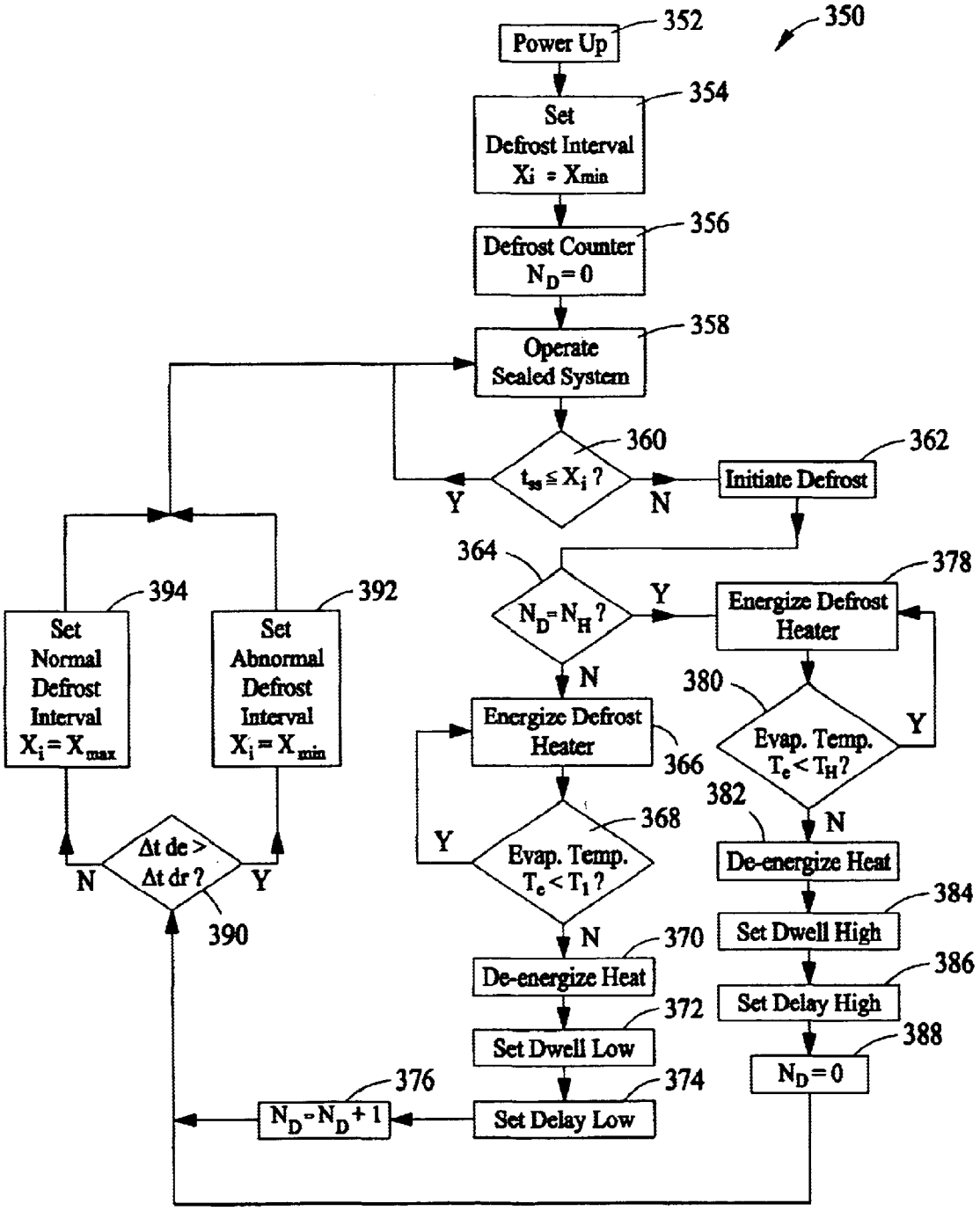
FIG. 6 is a method flow chart of an adaptive defrost algorithm executable by the controller shown in FIG. 2.

FIG. 6 is a method flow chart of an adaptive defrost method 350 executable by controller 160 (shown in FIG. 2) for energy efficient effective defrost while minimizing the effect of freezer compartment temperature during defrost operations.

As refrigerator controller 160 powers up 352, controller 160 sets 354 a time till defrost interval $X_i$ to a first or minimum length $X_{min}$, which in an exemplary embodiment corresponds to the abnormal cycle described above, namely eight hours of compressor run time undecremented by door openings or external factors. In alternative embodiments, however, it is recognized that $X_{min}$ may be greater or lesser than eight hours of compressor run time and further may be based or otherwise determined by other factors in lieu of or in addition to compressor run time.

Additionally upon power up, a defrost counter $N_D$ is set 356 to zero and controller 160 operates 358 the refrigerator sealed system to obtain set point temperatures in freezer compartment 104 and/or fresh food compartment 102 (shown in FIG. 1). Thus condenser fan speed 180, evaporator fan speed 182, compressor control 194, mullion damper 200, and pulse width modulator 208 for controlling the operating speed of condenser fan 210, fresh food compartment fan 212, and evaporator fan 214 (all shown in FIG. 2) are activated and regulated by controller 160 to cycle the appropriate components on and off to maintain refrigeration compartments 102, 104 at specified temperatures. As will be seen defrost counter $N_D$ is employed to determine whether a high temperature or low temperature defrost cycle will be activated.

As controller 160 operates the refrigerator sealed system, an elapsed sealed system time $t_{ss}$ is compared 360 to defrost interval $X_i$ set 354 by controller 160 upon power up. If elapsed sealed system time is less than the abnormal defrost time, i.e., if $t_{ss}<X_i$, then controller 160 continues to operate 358 the sealed system. If elapsed sealed system time is equal to or exceeds the abnormal defrost time, i.e., if $t_{ss}\geqq X_i$, then controller 160 initiates 362 defrost operations by pre-chilling freezer compartment 104 and turning off sealed system components to prepare for defrost. While pre-chilling of freezer compartment 104 is desirable in an illustrative embodiment, it is recognized that the low temperature defrost may partially, if not wholly, obviate the desirability of pre-chilling functions in alternative embodiments.

When defrost is initiated 362, controller 160 checks or compares 364 defrost counter $N_D$ to a predetermined value $N_H$ that corresponds to a high temperature defrost cycle. As will be seen further below, $N_D$ is incremented with each low temperature defrost cycle executed and reset to zero at the completion of a high temperature defrost cycle. Thus, low temperature defrost cycles will be successively executed for a predetermined number of times before a high temperature defrost cycle is executed. In an illustrative embodiment, $N_D$ equals five so that every fifth defrost is a high temperature defrost cycle. It is understood, however, that other values of $N_D$ may be employed in alternative embodiments without departing from the scope of the present invention.

If $N_D$ does not equal $N_H$ then a low temperature defrost is initiated and defrost heater 196 (shown in FIGS. 2–4) is energized 366 to heat the evaporator coils. Evaporator temperature is sensed or monitored and evaporator temperature ($T_e$) is compared 368 to a low defrost cycle termination temperature ($T_l$). In an illustrative embodiment $T_l$ is set to a temperature (about 55° F. in a particular embodiment) sufficient to melt frost off of the evaporator but not necessarily to defrost other components, such as an icemaker fill tube. Further, $T_l$ is selected to prevent freezer burn and moisture formation and ice buildup in freezer compartment 104 during the low temperature defrost cycle. In alternative embodiments it is appreciated that greater or lesser values for $T_l$ may be employed in lieu of about 55° F.

If actual evaporator temperature $T_e$ is less than $T_l$, controller 160 continues to energize 366 defrost heater 196. If actual evaporator temperature $T_e$ is not less than $T_l$ controller 160 de-energizes 370 defrost heater 196, sets 372 sealed system dwell time to a value corresponding to the low temperature defrost cycle, and also sets 374 a sealed system delay time to a value corresponding to the low temperature defrost cycle. As used herein, dwell refers to a period of time after defrost termination temperature is reached when the sealed system and evaporator fan are both off, and delay refers to time after the dwell period wherein the evaporator fan is off but the sealed system is on. The system will therefore remain in a dwell state for a certain time period and then in a delay state for another period of time. In the illustrative embodiment, the low temperature dwell time is set 372 to five minutes and the low temperature delay is set to zero (i.e., no delay). It is recognized that the foregoing low temperature dwell time and delay values are for illustrative purposes only and that other values may be employed in alternative embodiments.

Once defrost heater 196 is de-energized and low temperature dwell and delay values are set 372, 374, defrost counter ND is incremented 376 to its current value plus one for further use by controller 160.

When defrost operations are initiated 378, if $N_D$ does equal $N_H$ when $N_D$ and $N_H$ are compared 364, then a high temperature defrost is initiated and defrost heater 196 (shown in FIGS. 2–4) is energized 378 to heat the evaporator coils. Evaporator temperature is sensed or monitored and evaporator temperature ($T_e$) is compared 380 to a high defrost cycle termination temperature ($T_h$) that is different from low defrost cycle termination temperature $T_l$. In an illustrative embodiment $T_h$ is set to a temperature (about 65° F. in a particular embodiment) sufficient to melt frost off of the evaporator and to defrost other components, such as an icemaker fill tube, but without causing unacceptable temperature rises in freezer compartment 104. It is appreciated, however, that greater or lesser values for $T_h$ may be employed in lieu of about 65° F. in alternative embodiments.

If actual evaporator temperature $T_e$ is less than $T_h$, controller 160 continues to energize 378 defrost heater 196. If actual evaporator temperature $T_e$ is not less than $T_h$, controller 160 de-energizes 382 defrost heater 196, sets 384 sealed system dwell time to a value corresponding to the high temperature defrost cycle, and also sets 386 a sealed system delay time to a value corresponding to the high temperature defrost cycle. In the illustrative embodiment, the high temperature dwell time is set 384 to twenty minutes and the high temperature delay is set to 10 minutes. It is recognized, however, that the foregoing high temperature dwell time and delay values are for illustrative purposes only and that other values may be employed in alternative embodiments.

Once defrost heater 196 is de-energized 382 and high temperature dwell and delay values are set 384, 386, defrost counter ND is reset 388 to zero for further use by controller 160.

After defrost counter $N_D$ is reset 376, 388 upon completion of low temperature and high temperature defrosts, respectively, controller compares 390 elapsed defrost time $\Delta t_{de}$ (explained above in relation to FIG. 5) to defrost reference time $\Delta t_{dr}$ (also explained above in relation to FIG. 5). If elapsed defrost time $\Delta t_{de}$ is greater than the reference defrost time $\Delta t_{dr}$, defrost interval $X_i$ is set 392 to the first or minimum length $X_{min}$ corresponding to the abnormal defrost interval. Thus, in an illustrative embodiment defrost interval $X_{min}$ is about eight hours of compressor run time unaffected by door open events. As noted previously, however, it is understood that other measures besides compressor run time may be utilized in alternative embodiments to define $X_{min}$.

If elapsed defrost time a $\Delta t_{de}$ is not greater than the reference defrost time $\Delta t_{dr}$, defrost interval $X_i$ is set 394 to the second or maximum length $X_{max}$ corresponding to the normal defrost interval. Thus, in an illustrative embodiment defrost interval $X_{max}$ is about sixty hours of compressor run time decremented by door open events as described above in relation to FIG. 5. It is understood, however, that other measures besides decremented compressor run time may be utilized in alternative embodiments to define $X_{max}$.

Once defrost counter has been incremented or reset 376, 378 and $X_i$ has been determined as $X_{min}$ or $X_{max}$ 392, 394 as described above, controller 160 returns to operate 358 the sealed system with the current values of defrost counter ND and defrost interval $X_i$. The sealed system is operated and controller 160 compares 360 the sealed system time $t_{ss}$ with defrost interval $X_i$ until another defrost is initiated and the method repeats.

It is believed that the above-described methodology could be programmed and implemented in control logic by those in the art without further explanation.

A defrost system and method is therefore provided that utilizes a high termination temperature defrost at defined intervals in conjunction with a plurality of low temperature termination defrosts, and also employs normal and abnormal defrost intervals responsive to refrigerator usage through door open events. By using a low termination temperature defrost frequently and a high termination temperature defrost infrequently, freezer burn and moisture/ice buildup is substantially avoided and energy efficiency improved while providing satisfactory defrost performance.

While the invention has been described in terms of various specific embodiments, those skilled in the art will recognize that the invention can be practiced with modification within the spirit and scope of the claims.

What is claimed is:

1. A method for defrosting an evaporator of a refrigeration system, the method utilizing a defrost heater and a controller operatively connected to the evaporator and the defrost heater, said method comprising:

initiating a defrost cycle to energize the defrost heater to defrost the evaporator;

monitoring a temperature of the evaporator;

terminating the defrost cycle by de-energizing the defrost heater when a low temperature termination point of the evaporator is reached when in a low temperature defrost cycle; and terminating the defrost cycle by de-energizing the defrost heater when a high temperature termination point of the evaporator is reached when in a high temperature defrost cycle.

2. A method in accordance with claim 1, the controller including a defrost counter, said method further comprising determining whether a defrost cycle is a high temperature defrost cycle or a low temperature defrost cycle based upon a value of the defrost counter.

3. A method in accordance with claim 2 further comprising:

incrementing the defrost counter when a low temperature defrost cycle is completed; and resetting the defrost counter when a high temperature defrost cycle is completed.

4. A method in accordance with claim 1 further comprising:

comparing an elapsed defrost time to a reference defrost time; and determining a normal or abnormal defrost interval based upon the compared elapsed defrost time and reference defrost time.

5. A method for defrosting a refrigeration unit including an evaporator, a defrost heater, and a controller operatively connected to the evaporator and the defrost heater, the controller including a defrost counter, said method comprising:

initiating a defrost cycle to energize the defrost heater to defrost the evaporator;

selecting a low temperature defrost cycle when the defrost counter is less than a predetermined value; and selecting a high temperature defrost cycle when the defrost counter equals said predetermined value.

6. A method in accordance with claim 5 further comprising:

terminating the low temperature defrost cycle by de-energizing the defrost heater when a first temperature termination point of the evaporator is reached; and terminating the high temperature defrost cycle by de-energizing the defrost heater when a second temperature termination point of the evaporator is reached, the second termination temperature higher than the first termination temperature.

7. A method in accordance with claim 6 further comprising:

selecting a first refrigeration system dwell value when the low temperature defrost cycle is terminated; and selecting a second refrigeration system dwell value when the high temperature defrost cycle is terminated, the second dwell value higher than the first value.

8. A method in accordance with claim 6 further comprising:

selecting a first refrigeration system delay value when the low temperature defrost cycle is terminated; and selecting a second refrigeration system delay value when the high temperature defrost cycle is terminated, the second delay value higher than the first value.

9. A method in accordance with claim 6 further comprising:

incrementing the defrost counter when the low temperature defrost cycle is terminated; and resetting the defrost counter when the low temperature defrost cycle is terminated.

10. A method for defrosting a refrigerator including a sealed system, an evaporator, a defrost heater, and a controller operatively connected to the evaporator and a defrost heater, the controller including a defrost counter and a defrost timer, said method comprising:

initiating a defrost cycle to energize the defrost heater to defrost the evaporator;

selecting a low temperature defrost cycle when the defrost counter is less than a predetermined value;

selecting a high temperature defrost cycle when the defrost counter equals the predetermined value;

terminating the low temperature defrost cycle by de-energizing the defrost heater when a first temperature termination point of the evaporator is reached when the low temperature defrost cycle is selected;

terminating the high temperature defrost cycle by de-energizing the defrost heater when a second temperature termination point of the evaporator is reached when the high temperature defrost cycle is selected, the second termination temperature higher than the first termination temperature;

comparing an elapsed defrost time to a reference defrost time when either of the high temperature defrost and low temperature defrost are terminated;

selecting a normal or abnormal defrost interval based upon the compared elapsed defrost time and reference defrost time; and operating the sealed system for the selected defrost interval.

11. A method in accordance with claim 10 further comprising incrementing the defrost counter when the low temperature defrost cycle is terminated; and resetting the defrost counter when the high temperature defrost cycle is terminated.

12. A refrigeration defrost unit for an evaporator, said defrost unit comprising:

a defrost heater;

a controller operatively coupled to said defrost heater; and a thermistor adapted for sensing a temperature of the evaporator, said controller configured to operate said defrost heater in a low temperature defrost mode de-energizing said defrost heater at a first temperature in response to said thermistor, and to operate said defrost heater in a high temperature defrost mode de-energizing said defrost heater at a second temperature in response to said thermistor, said second temperature higher than said first temperature.

13. A refrigeration defrost unit in accordance with claim 12, said controller comprising a defrost counter, said controller configured to operate said defrost heater in said low temperature defrost mode or said high temperature defrost mode based upon a value of the defrost counter.

14. A refrigeration defrost unit in accordance with claim 13 further comprising a compressor, said controller further comprising a defrost timer and a defrost reference time, said controller configured to operate said compressor for a selected interval based upon a comparison of an elapsed defrost time to the reference time.

15. A refrigeration unit comprising:

a compressor;

an evaporator;

a defrost heater; and a controller, said controller operatively coupled to said compressor, said evaporator and said defrost heater, said controller comprising a defrost timer and configured to operate said compressor in a normal mode and an abnormal load in response to a value of the defrost timer, and said controller further comprising a defrost counter and configured to operate said defrost heater in a high temperature defrost mode and a low temperature defrost mode based upon a value of said counter.

16. A refrigeration unit in accordance with claim 15 further comprising a thermistor coupled to said evaporator and to said controller, said controller configured to de-energize said defrost heater at a first temperature reference point in response to said thermistor when in the low temperature defrost mode, and said controller also configured to de-energize said defrost heater at a second temperature reference point in response to said thermistor when in the high temperature defrost mode.

17. A refrigeration unit in accordance with claim 16 wherein said first temperature reference point is about 55° F.

18. A refrigeration unit in accordance with claim 15 wherein said controller is adapted to operate said defrost heater in said high temperature defrost mode when said menu counter has a value of five, thereby making every fifth defrost cycle a high temperature defrost cycle.

19. A refrigerator comprising:

a cabinet defining at least one refrigeration compartment;

a sealed system for cooling said at least one refrigeration compartment;

a defrost heater; and a controller operatively coupled to said sealed system and to the defrost heater;

said controller configured to adaptively control said defrost heater and said sealed system in a high temperature defrost mode and a low temperature defrost mode between normal and abnormal defrost intervals.

20. A refrigerator in accordance with claim 19 further comprising at least one refrigeration compartment door, said controller configured to operate said sealed system for normal and abnormal intervals based upon a number of openings of said compartment door.

21. A refrigerator in accordance with claim 19, said sealed system comprising an evaporator, said controller adapted to monitor a temperature of said evaporator and terminate said high temperature defrost at a first termination temperature of said evaporator and to terminate said low temperature defrost at a second termination temperature of said evaporator.

22. A refrigerator in accordance with claim 21 wherein said second termination temperature is about 55° F.

23. A refrigerator in accordance with claim 21 wherein said first termination temperature is about 65° F.

24. A refrigerator in accordance with claim 19, said controller configured to execute a high temperature defrost cycle about every fifth defrost cycle.

* * * * *